US006305997B1

(12) United States Patent
Whiteside et al.

(10) Patent No.: US 6,305,997 B1
(45) Date of Patent: Oct. 23, 2001

(54) SELF-ALIGNING UNIVERSAL JOINT ASSEMBLY FOR A STERN DRIVE

(75) Inventors: Mark Whiteside, Zion; Stephen R. Johnson, Waukegan; Arthur R. Ferguson, Glenview, all of IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/543,437

(22) Filed: Apr. 5, 2000

(51) Int. Cl.[7] ..... B63H 5/125
(52) U.S. Cl. ..... 440/57; 440/83
(58) Field of Search ..... 33/600, 603, 645, 33/606; 440/53, 57, 64, 83, 111, 112

(56) References Cited

U.S. PATENT DOCUMENTS 3,404,656 * 10/1968 Chamberlain ..... 440/64
4,201,391 5/1980 Bankstahl .
4,634,391 1/1987 Entringer et al. .
4,957,462 9/1990 Erickson .
5,836,067 11/1998 Cochran .

* cited by examiner

*Primary Examiner*—Ed Swinehart
(74) *Attorney, Agent, or Firm*—Timothy J. Ziolkowski

(57) ABSTRACT

An assembly and techniques for facilitating assemblage of a drive unit to a gimbal housing in a boat are provided. The assembly uses a universal joint (U-joint) in the gimbal housing for pivotally engaging the drive unit to the gimbal housing. The U-joint includes an input shaft that receives driving power and an output shaft connectable to the drive unit. The assembly further uses an alignment subassembly configured to support the U-joint in an alignment position while its output shaft is being connected to the drive unit.

74 Claims, 4 Drawing Sheets

SELF-ALIGNING UNIVERSAL JOINT ASSEMBLY FOR A STERN DRIVE

BACKGROUND OF THE INVENTION

The present invention is generally related to marine propulsion systems, and, more particularly, the present invention is related to a stern drive system and techniques using a universal joint (U-joint) assembly having an alignment subassembly that facilitates assemblage of a vertical drive unit to a mount assembly that extends through the transom of a boat.

Although marine propulsion systems, such as stern drives, provide versatile and proficient means of propulsion to pleasure boats, etc., typical stern drive systems have presented some assemblage challenges to boat manufacturers and servicing personnel, such as assemblage of their vertical drive unit or outdrive to the transom mount assembly.

FIG. 1 illustrates a typical vertical drive unit 30 having a U-joint 27 with a U-joint shaft 28 which, as will be readily understood by those skilled in the art, needs to be sufficiently long to extend through the transom mount assembly to engage an engine coupler 23 (FIG. 2) connected to receive driving power from an engine crankshaft. The challenges arise since aligning the relatively long U-joint shaft attached to the vertical drive unit relative to the engine coupler is not easy. For example, the engine coupler may not be readily visible during assembly operations, and thus, engine position becomes very critical to ensure the alignment required to provide a lasting and trouble-free mechanical connection. Although engine alignment tools have been used to attempt to provide proper alignment of the engine relative to the U-joint, such tools have only been partially effective being that they add to the cost and time of engine installation, and the assemblage process from time to time may require reinstallation of the engine even when using such tools.

In view of the above-described difficulties, it would be desirable to provide an assembly that provides a relatively shorter U-joint shaft that can be readily placed into an alignment position without having to depend on the burdensome engine alignment operations generally used heretofore. It is further desirable to provide a kit that facilitates assemblage of the outdrive to a gimbal housing that houses a U-joint for pivotally engaging the outdrive to the gimbal housing. It is still desirable to provide techniques for facilitating assemblage of the outdrive to the gimbal housing.

SUMMARY OF THE INVENTION

Generally speaking, the present invention fulfills the foregoing needs by providing in one embodiment a propulsion system that extends through a boat transom and comprises an engine, a gimbal housing, and a drive unit. The propulsion system further comprises a universal joint (U-joint) in the gimbal housing for pivotally engaging the drive unit to the gimbal housing. The U-joint includes an input shaft that receives power from the engine and an output shaft connectable to the drive unit. An alignment assembly is configured to support the U-joint in an alignment position while its output shaft is being connected to the drive unit.

The present invention may further fulfill the foregoing needs by providing an assembly for facilitating assemblage of a drive unit to a gimbal housing in a boat. The assembly comprises a universal joint (U-joint) in the gimbal housing for pivotally engaging the drive unit to the gimbal housing. The U-joint includes an input shaft that receives driving power and an output shaft connectable to the drive unit. The assembly further comprises an alignment subassembly configured to support the U-joint in an alignment position while its output shaft is being connected to the drive unit.

In another aspect of the invention, a method is provided for facilitating assemblage of a drive unit to a gimbal housing in a boat using a universal joint (U-joint) in the gimbal housing for pivotally engaging the drive unit to the gimbal housing. The U-joint includes an input shaft that receives driving power and an output shaft connectable to the drive unit. The method allows for providing an alignment assembly. The method further allows for positioning the alignment assembly to support the U-joint in an alignment position while its output shaft is being connected to the drive unit.

Figure 1:
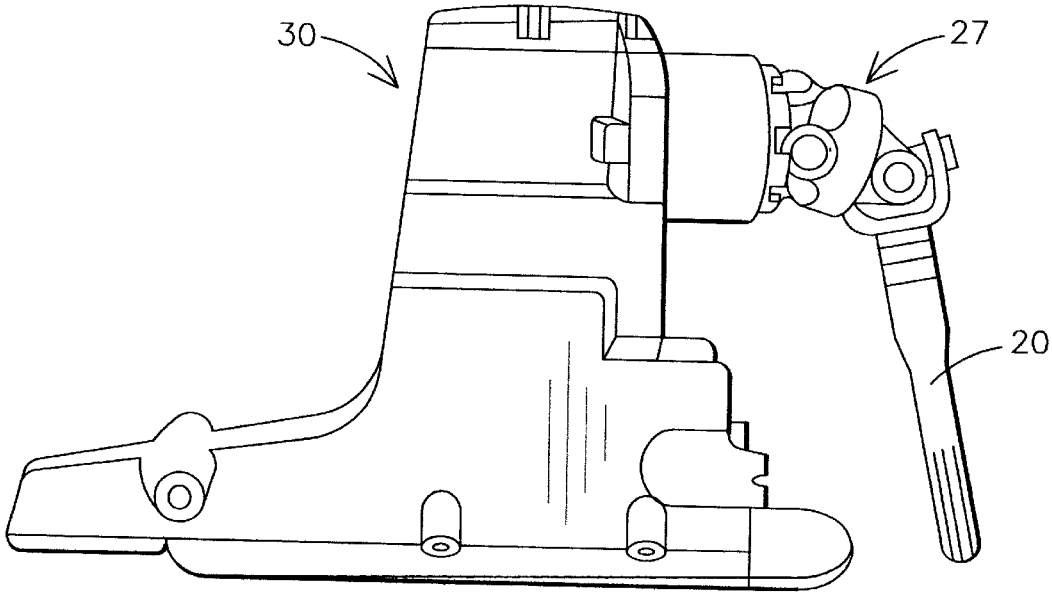
FIG. 1 PRIOR ART
FIG. 1 shows an elevational side view of a typical vertical drive unit that may have presented some assemblage issues in view of its relatively long drive shaft.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Figure 2:
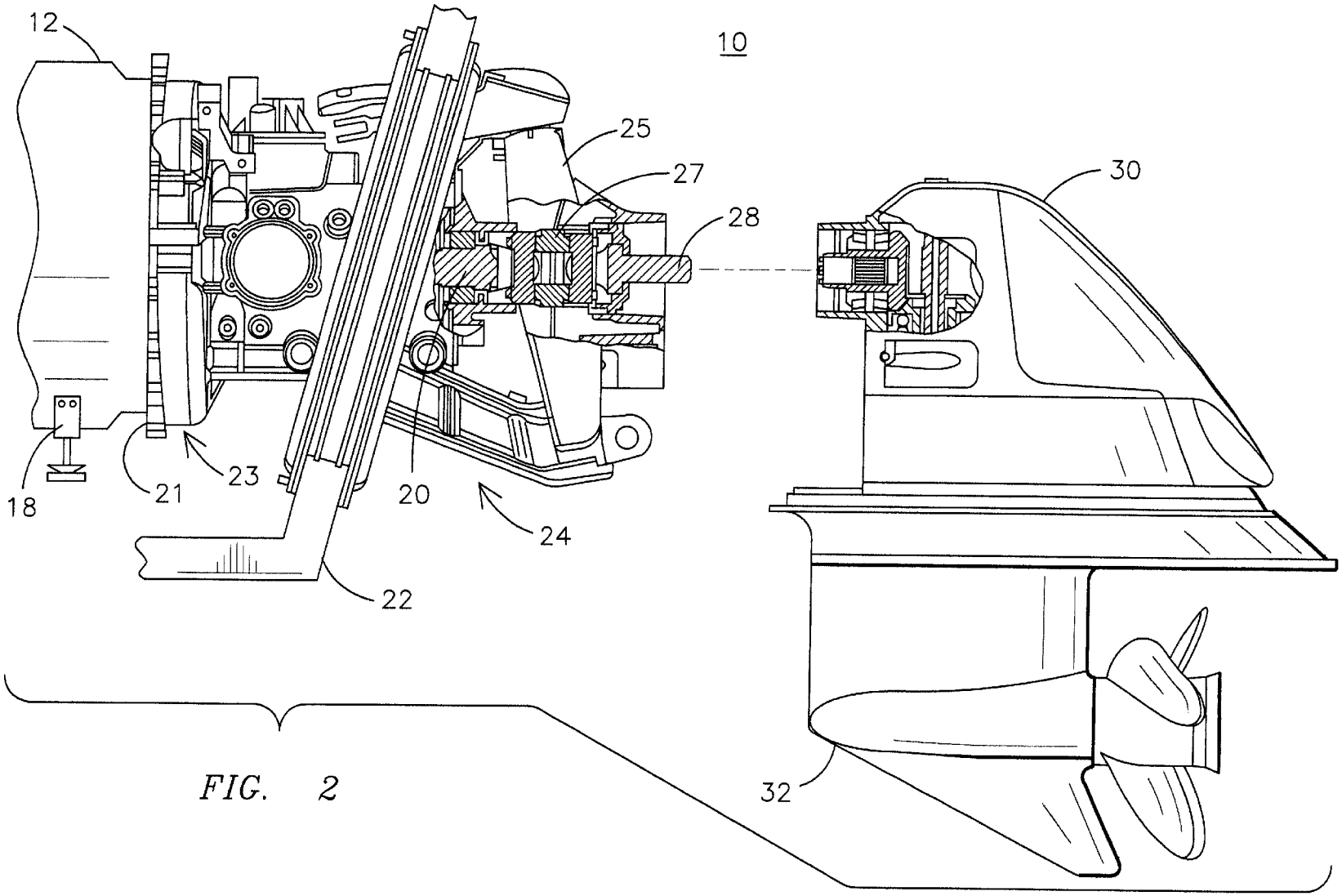
FIG. 2 shows a fragmentary cross-sectional side view of an exemplary marine propulsion prior to assemblage of an outdrive to a U-joint assembly embodying the present invention.
Figure 3:
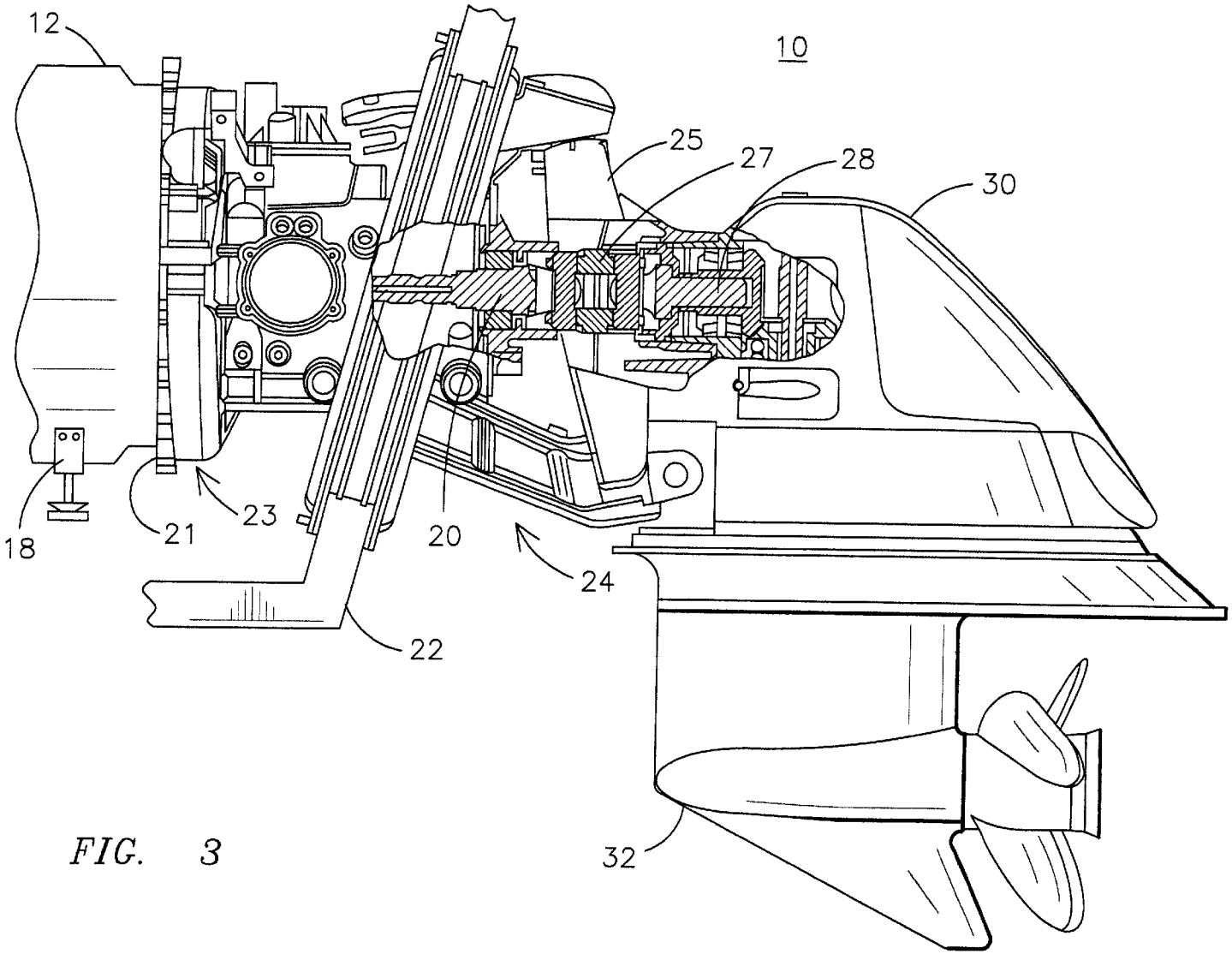
FIG. 3 shows the marine propulsion system of FIG. 2 subsequent to assemblage of the outdrive to the U-joint assembly.

FIG. 2 shows an exemplary marine propulsion system 10 prior to assemblage of its outdrive to a U-joint coupler and which assemblage is substantially facilitated by the alignment assembly of the present invention. Marine propulsion system 10 is illustrated in FIG. 2 as having an engine 12 located within a boat having a transom 22. Standard engine mounts 18 may attach the engine 12 to the boat. The engine 12 provides power through a crankshaft rotating at an engine revolution rate and outputs power to a drive shaft 20. The drive shaft 20 either extends through or is coupled through the transom 22 of the boat. A gimbal housing 24 may extend through the transom 22 to be supported by engine 12 at a suitable mounting flange 21. As will be readily understood by those skilled in the art, the gimbal housing supports a gimbal unit 25, such as may be made up of a pivot housing and a gimbal ring. Gimbal unit 25 is horizontally pivotable to provide steering to the boat in a desired direction of travel and is further vertically pivotable to provide, for example, a desired trim relative to the water plane over which the boat travels. Gimbal unit 25 accommodates a universal joint 27 comprising at one end thereof an input shaft, e.g., drive shaft 20, and comprising at an opposite end an output shaft 28 connectable, as shown in FIG. 3, to a vertical drive unit or outdrive 30 for allowing the vertical and horizontal pivoting. Standard gears and driveshafts within outdrive 30 in operation cooperate to transmit the power from the output shaft 28 to a propeller shaft located in a lower gearcase 32 appended at the lower end of drive unit 30. Such operation is well-known to those of ordinary skill in the art and need not be described in any greater detail for purposes of the present invention.

Figure 5:
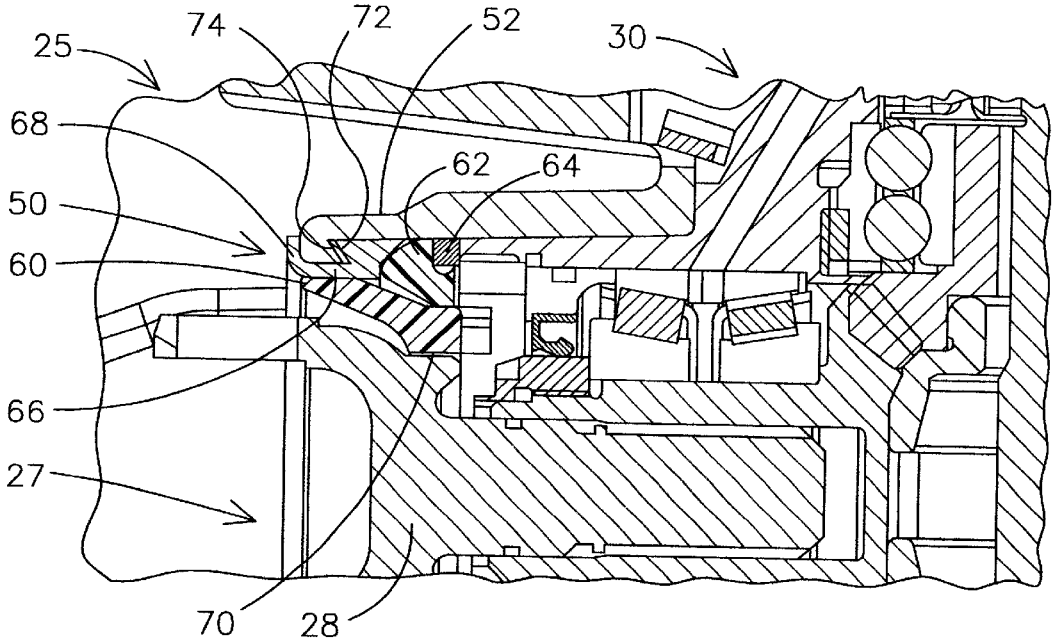
FIG. 5 is a cross-sectional view of one exemplary multi-piece embodiment of the alignment assembly of the present invention.
Figure 4:
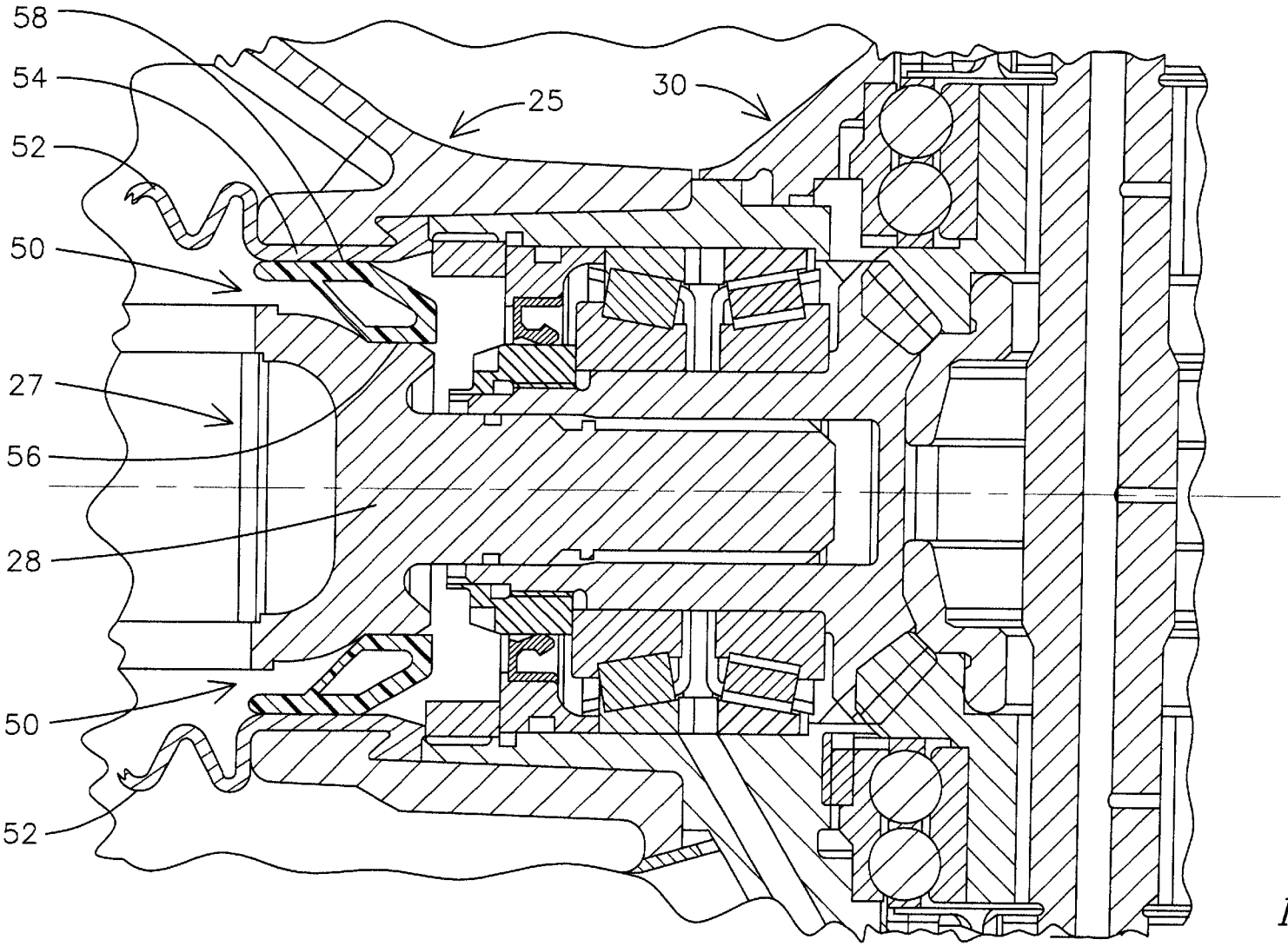
FIG. 4 is a cross-sectional view of one exemplary single-piece embodiment of the alignment assembly of the present invention.

FIG. 4 illustrates one exemplary embodiment of an alignment assembly 50 configured to support U-joint 27 in an alignment position while its output shaft 28 is being connected to drive unit 30. As shown in FIG. 4, and as will be readily understood by those skilled in the art, a bellows enclosure 52, preferably a flexible bellows enclosure made up of a suitable standard rubber material, encloses or encircles the U-joint coupling and may be secured at a proximate end (not shown) relative to the boat transom using standard transom sealing techniques. As shown in FIGS. 4 and 5, a distal end 54 of the bellows enclosure relative to the boat transom is used for supporting alignment assembly 50.

The exemplary embodiment of alignment assembly 50 comprises a single piece assembly having inner and outer sections 56 and 58, such as co-axially disposed cylindrical sections. In particular, inner section 56 is configured to support U-joint 27 in the alignment position while output shaft 28 is being connected to drive unit 30. Outer section 58 of assembly 50 is configured to be axially slideable relative to bellows enclosure 52 so that inner section 56 is free from interference with U-joint 27 during rotational operation of U-joint 27 and associated components. For example, outer section 58 should have a diameter dimensioned sufficiently wide to provide relatively comfortable snug interference fit with bellows enclosure 52 so that the inner section of the single-piece assembly supports the U-joint in the alignment position while being connected to the drive unit. Further, the diameter of outer section 58 should be dimensioned sufficiently narrow to permit axially slideable movement relative to bellows enclosure 52 so that its inner section 56 is free from interference with U-joint 27 during rotational operation.

FIG. 5 illustrates another exemplary embodiment of assembly 50 made up of multiple pieces, such as a U-joint support piece 60, a bellows retainer piece 62 and a seal 64. As shown in FIG. 5, U-joint support piece 60 comprises an outer surface 66, such as a cylindrical outer surface, supported by a shoulder 68 in gimbal unit 25. U-joint support piece 60 further comprises an inner surface 70, which may also be a cylindrical surface, for supporting U-joint 27 in the alignment position while being connected to vertical drive unit 30. As shown in FIG. 5, shoulder 68 may include a surface 72 positioned to engage a similarly configured corresponding surface 74 in the distal end of bellows enclosure 52.

As further shown in FIG. 5, bellows retainer section 62 is configured to be positioned between bellows 52, shoulder 68 and U-joint support piece 60 to ensure bellows engagement even though outer surface 66 of support piece 60 is axially slideable relative to shoulder 68 so that inner surface 70 is free from interference with U-joint 27 during rotational operation of U-joint 27 and associated components. It will be appreciated that either of the embodiments of alignment assembly 50 shown in FIGS. 4 and 5 may be made of a suitable rigid and dimensionally stable polymer material, such as plastic. It will be appreciated, however, that the alignment assembly need not be limited to polymers being that other materials including metal, metal alloys, etc., could be employed, if so desired.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A propulsion system extending through a boat transom and comprising:

an engine interiorly located relative to the boat transom;

a gimbal housing connected to the engine and having a U-joint therein, the U-joint having an input shaft that receives power from the engine and an output shaft extending rearwardly therefrom;

a drive unit pivotally connected to the gimbal housing; and an alignment assembly configured to support the U-joint and output shaft in an alignment position only during assembly of the drive unit to the gimbal housing.

2. The propulsion system of claim 1 wherein the alignment assembly is further configured to avoid interference with the U-joint during operational rotation thereof.

3. The propulsion system of claim 2 further comprising a bellows enclosure supported by a gimbal unit, the bellows enclosure having a distal end relative to the boat transom for supporting the alignment assembly.

4. The propulsion system of claim 3 wherein the alignment assembly comprises a single-piece assembly.

5. The propulsion system of claim 4 wherein the single piece assembly comprises co-axially disposed inner and outer sections.

6. The propulsion system of claim 5 wherein the inner section of the single piece assembly is configured to support the U-joint in the alignment position while being connected to the drive unit.

7. The propulsion system of claim 6 wherein the outer section of the single-piece assembly is configured to be axially slidable relative to the bellows enclosure so that the inner section of the single-piece assembly is free from interference with the U-joint during rotational operation thereof.

8. The propulsion system of claim 4 wherein the single piece assembly comprises co-axially disposed inner and outer cylindrical sections.

9. The propulsion system of claim 8 wherein the outer section of the single-piece assembly has a diameter dimensioned sufficiently wide to provide snug interference fit with the bellows enclosure so that the inner section of the single-piece assembly supports the U-joint into the alignment position while being connected to the drive unit.

10. The propulsion system of claim 9 wherein the diameter of the outer section is further dimensioned sufficiently narrow to permit axially slidable movement relative to the bellows enclosure so that the inner section is free from interference with the U-joint during operational rotation thereof.

11. The propulsion system of claim 2 wherein the alignment assembly comprises a multi-piece assembly.

12. The propulsion system of claim 11 wherein the multi-piece assembly comprises a U-joint support piece, and a bellows retainer piece.

13. The propulsion system of claim 12 wherein the U-joint support piece comprises an outer surface supported by a shoulder in the gimbal unit and further comprises an inner surface for supporting the U-joint in the alignment position while being connected to the drive unit.

14. The propulsion system of claim 13 wherein the respective outer and inner surfaces of the U-joint support comprise respective cylindrical surfaces.

15. The propulsion system of claim 13 wherein the shoulder in the gimbal unit further engages a bellows enclosure.

16. The propulsion system of claim 15 wherein the bellows retainer piece is configured to be positioned between the bellows, the shoulder and the U-joint support piece to ensure bellows engagement even though the outer surface of the support piece is axially slidable relative to the gimbal unit shoulder so that the inner surface of the support piece is free from interference with the U-joint during rotational operation thereof.

17. The propulsion system of claim 16 wherein the multi-piece assembly further comprises a seal to prevent entry of moisture therethrough.

18. The propulsion system of claim 17 wherein the bellows retainer includes a flange for receiving the seal.

19. The propulsion system of claim 1 wherein said propulsion system comprises a stern drive system.

20. A propulsion system extending through a boat transom and comprising:

an engine interiorly located relative to the boat transom;

a gimbal housing connected to the engine, the gimbal housing supporting a gimbal unit;

a drive unit pivotally connected to the gimbal housing by a U-joint having an input shaft that receives power from the engine and an output shaft connectable to the drive unit;

a bellows enclosure supported by the gimbal unit, the bellows enclosure having a distal end relative to the boat transom for supporting an alignment assembly configured to support the U-joint in an alignment position while its output shaft is being connected to the drive unit, the alignment assembly being further configured to avoid interference with the U-joint during operational rotation thereof.

21. A propulsion system extending through a boat transom and comprising:

an engine located inside the boat;

a gimbal housing connected to the engine;

a drive unit pivotally connected to the gimbal housing by a U-joint including an input shaft that receives power from the engine and an output shaft connectable to the drive unit; and a single-piece alignment assembly configured to support the U-joint in an alignment position while the output shaft is being connected to the drive unit, the single piece assembly comprising co-axially disposed inner and outer sections wherein the inner section is configured to support the U-joint in the alignment position while being connected to the drive unit and the outer section of the single piece assembly is configured to be axially slidable relative to a bellows enclosure so that the inner section of the single piece assembly is free from interference with the U-joint during operational rotation thereof.

22. A propulsion system extending through a boat transom and comprising:

an engine located inside the boat;

a gimbal housing having a U-joint therein with an input end connected to the engine and an output end extending rearwardly therefrom;

a drive unit pivotally connected to the gimbal housing and receiving the output end of the U-joint therein; and a multi-piece alignment assembly configured to support the output end of the U-joint in an alignment position while the output shaft is being connected to the drive unit, the multi-piece assembly comprising a U-joint support piece, and a bellows retainer piece and wherein the U-joint support piece comprises an outer surface supported by a shoulder in a gimbal unit and further comprises an inner surface for supporting the U-joint in the alignment position while being connected to the drive unit.

23. The propulsion system of claim 22 further comprising a bellows enclosure supported by the gimbal unit, the bellows enclosure having a distal end relative to the boat transom for supporting the alignment assembly.

24. The propulsion system of claim 23 wherein the bellows retainer section is configured to be positioned between the bellows, the shoulder and the U-joint support piece to ensure bellows engagement even though the outer surface of the support piece is axially slidable relative to the gimbal unit shoulder so that the inner surface of the support piece is free from interference with the U-joint during operational rotation thereof.

25. The propulsion system of claim 24 wherein the multi-piece assembly further comprises a seal to prevent entry of moisture therethrough.

26. The propulsion system of claim 25 wherein the bellows retainer includes a flange for receiving the seal.

27. An alignment assembly for facilitating assemblage of a drive unit to a gimbal housing in a boat using a U-joint for drivingly engaging the drive unit to an engine through the gimbal housing, the U-joint including an input end that receives driving power and an output end connectable to the drive unit, the alignment assembly comprising;

means for positioning the alignment assembly to support the output end of the U-joint in an alignment position while its output shaft is being inserted into the drive unit; and means for positioning the alignment assembly to avoid interference with the output end of the U-joint during operational rotation thereof.

28. The assembly of claim 27 further comprising bellows means for supporting the alignment assembly.

29. The assembly of claim 28 wherein said assembly is a single piece assembly.

30. The assembly of claim 29 wherein the single piece assembly comprises inner and outer sections.

31. The assembly of claim 30 wherein the inner section of the single piece assembly includes means for supporting the U-joint in the alignment position while being connected to the drive unit.

32. The assembly of claim 31 wherein the outer section includes means for providing axially slidable movement relative to the bellows means so that the inner section of the single piece assembly is free from interference with the U-joint during operational rotation thereof.

33. The assembly of claim 32 wherein the diameter of the outer section of the single piece assembly is dimensioned sufficiently wide to provide snug interference fit with the bellows means so that the inner section of the single piece assembly supports the U-joint into the alignment position while being connected to the drive unit.

34. The assembly of claim 33 wherein the diameter of the outer section of the single-piece assembly is dimensioned sufficiently narrow to permit axially slidable movement relative to the bellows means so that the inner section is free from interference with the U-joint during operational rotation thereof.

35. The assembly of claim 28 wherein said assembly comprises a multi-piece assembly.

36. The assembly of claim 35 wherein the multi-piece assembly comprises a U-joint supporting means, and a bellows retaining means.

37. The assembly of claim 36 wherein the gimbal unit includes means for supporting an outer surface of the U-joint support means and wherein said U-joint supporting means includes means for supporting the U-joint in the alignment position while being connected to the drive unit.

38. The assembly of claim 37 further comprising means for positioning the bellows retaining means to ensure bellows engagement even though the outer surface of the U-joint supporting means is axially slidable relative to the gimbal unit so that the inner surface of the U-joint supporting means is free from interference with the U-joint during rotational operation thereof.

39. The assembly of claim 38 further comprising means for sealing the multi-piece assembly.

40. Assembly for facilitating assemblage of a drive unit to a gimbal housing in a boat, said assembly comprising:

a U-joint in the gimbal housing for pivotally transferring drive power from an engine to the drive unit, the U-joint including an input shaft that receives driving power and an output shaft connectable to the drive unit; and an alignment subassembly configured to support the output shaft of the U-joint in an alignment position until connected to the drive unit.

41. The assembly of claim 40 wherein the alignment subassembly is further configured to avoid interference with the U-joint during operational rotation thereof.

42. The assembly of claim 41 further comprising a bellows enclosure supported by a gimbal unit, the bellows enclosure having a distal end relative to the boat transom for supporting the alignment subassembly.

43. The assembly of claim 42 wherein the alignment subassembly comprises a single-piece subassembly.

44. The assembly of claim 43 wherein the single piece subassembly comprises co-axially disposed inner and outer sections.

45. The assembly of claim 44 wherein the inner section of the single piece subassembly is configured to support the U-joint in the alignment position while being connected to the drive unit.

46. The assembly of claim 45 wherein the outer section of the single-piece subassembly is configured to be axially slidable relative to the bellows enclosure so that the inner section of the single-piece subassembly is free from interference with the U-joint during rotational operation thereof.

47. The assembly of claim 43 wherein the single piece subassembly comprises co-axially disposed inner and outer cylindrical sections.

48. The assembly of claim 47 wherein the outer section of the single-piece subassembly has a diameter dimensioned sufficiently wide to provide snug interference fit with the bellows enclosure so that the inner section of the single-piece subassembly supports the U-joint into the alignment position while being connected to the drive unit.

49. The assembly of claim 48 wherein the diameter of the outer section is further dimensioned sufficiently narrow to permit axially slidable movement relative to the bellows enclosure so that the inner section is free from interference with the U-joint during operational rotation thereof.

50. The assembly of claim 41 wherein the alignment subassembly comprises a multi-piece assembly.

51. The assembly of claim 50 wherein the multi-piece subassembly comprises a U-joint support piece, and a bellows retainer piece.

52. The assembly of claim 51 wherein the U-joint support piece comprises an outer surface supported by a shoulder in a gimbal unit and further comprises an inner surface for supporting the U-joint in the alignment position while being connected to the drive unit.

53. The assembly of claim 52 wherein the respective outer and inner surfaces of the U-joint support comprise respective cylindrical surfaces.

54. The assembly of claim 52 wherein the shoulder in the gimbal unit further engages a bellows enclosure.

55. The assembly of claim 54 wherein the bellows retainer piece is configured to be positioned between the bellows, the gimbal unit shoulder and the U-joint support piece to ensure bellows engagement even though the outer surface of the support piece is axially slidable relative to the gimbal unit shoulder so that the inner surface of the support piece is free from interference with the U-joint during rotational operation thereof.

56. The assembly of claim 55 wherein the multi-piece subassembly further comprises a seal to prevent entry of moisture therethrough.

57. The assembly of claim 56 wherein the bellows retainer includes a flange for receiving the seal.

58. A method for facilitating assemblage of a drive unit to a gimbal housing in a boat using a U-joint in the gimbal housing for pivotally driving the drive unit to an engine through the gimbal housing, the U-joint including an input shaft that receives driving power and an output shaft connectable to the drive unit, said method comprising:

providing an alignment assembly; and positioning the alignment assembly to support the output shaft of the U-joint in an alignment position while the output shaft is being inserted into to the drive unit and repositioning the alignment assembly away from the output shaft after the drive unit is mated to the gimbal housing.

59. The method of claim 58 further comprising positioning the alignment assembly to avoid interference with the U-joint during operational rotation thereof.

60. The method of claim 58 further comprising providing a bellows enclosure through a gimbal unit supported by the gimbal housing, the bellows enclosure having a distal end relative to the boat transom for supporting the alignment assembly.

61. The method of claim 60 further comprising configuring the alignment assembly as a single-piece assembly.

62. The method of claim 61 further comprising coaxially disposing inner and outer sections in the single piece assembly.

63. The method of claim 62 further comprising configuring the inner section of the single piece assembly to support the U-joint in the alignment position while being connected to the drive unit.

64. The method of claim 63 further comprising configuring the outer section of the single-piece assembly to be axially slidable relative to the bellows enclosure so that the inner section of the single-piece assembly is free from interference with the U-joint during rotational operation thereof.

65. The method of claim 61 further comprising coaxially disposing inner and outer cylindrical sections in the single piece assembly.

66. The method of claim 65 further comprising dimensioning the diameter of the outer section of the single-piece assembly to be sufficiently wide to provide snug interference fit with the bellows enclosure so that the inner section of the single-piece assembly supports the U-joint into the alignment position while being connected to the drive unit.

67. The method of claim 66 further comprising dimensioning the diameter of the outer section to be sufficiently narrow to permit axially slidable movement relative to the bellows enclosure so that the inner section is free from interference with the U-joint during operational rotation thereof.

68. The method of claim 59 further comprising configuring the alignment assembly as a multi-piece assembly.

69. The method of claim 68 wherein the multi-piece assembly comprises a U-joint support piece, and a bellows retainer piece.

70. The method of claim 68 further comprising defining an outer surface in the U-joint support piece to be supported by a shoulder in the gimbal unit and further comprises defining an inner surface for supporting the U-joint in the alignment position while being connected to the drive unit.

71. The method of claim 70 wherein the respective outer and inner surfaces of the U-joint support comprise respective cylindrical surfaces.

72. The method of claim 70 further comprising engaging the shoulder in the gimbal unit to a bellows enclosure.

73. The method of claim 72 further comprising configuring the bellows retainer section to be positioned between the bellows, the shoulder and the U-joint support piece to ensure bellows engagement even though the outer surface of the support piece is axially slidable relative to the gimbal unit shoulder so that the inner surface of the support piece is free from interference with the U-joint during rotational operation thereof.

74. The method of claim 73 further providing a seal in the multi-piece assembly to prevent entry of moisture therethrough.

* * * * *